US012247468B2

(12) United States Patent
Moreno et al.

(10) Patent No.: US 12,247,468 B2
(45) Date of Patent: Mar. 11, 2025

(54) INFLOW CONTROL DEVICE, METHOD, AND SYSTEM

(71) Applicant: Baker Hughes Oilfield Operations LLC, Houston, TX (US)

(72) Inventors: Oscar Becerra Moreno, Katy, TX (US); Jai Kishan Koli, Edmonton (CA); Alexander Kendall, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/356,848

(22) Filed: Jul. 21, 2023

(65) Prior Publication Data

US 2025/0027393 A1 Jan. 23, 2025

(51) Int. Cl.
*E21B 43/12* (2006.01)

(52) U.S. Cl.
CPC ..... *E21B 43/124* (2013.01)

(58) Field of Classification Search
CPC ..... E21B 43/124
See application file for complete search history.

(56) References Cited

U.S. PATENT DOCUMENTS 4,497,664 A * 2/1985 Verry ..... B08B 3/02 239/524
10,550,671 B2 2/2020 Stolboushkin
10,794,162 B2 10/2020 Stolboushkin et al.
11,326,432 B2 5/2022 Stolboushkin et al.
11,441,403 B2 9/2022 Stolboushkin
11,578,546 B2 2/2023 Stolboushkin et al.
2016/0010425 A1* 1/2016 Dyck ..... E21B 43/12 166/380
2016/0333664 A1* 11/2016 Ismail ..... E21B 34/10
2019/0178069 A1* 6/2019 Stolboushkin ..... E21B 43/10
2021/0230979 A1* 7/2021 Zhu ..... E21B 43/241
2021/0238939 A1* 8/2021 Stolboushkin ..... F15D 1/06
2021/0278106 A1* 9/2021 O'Malley ..... E21B 43/12
2023/0100622 A1* 3/2023 Klimack ..... E21B 41/0078 166/222

FOREIGN PATENT DOCUMENTS

WO 2017083295 A1 5/2017

* cited by examiner

*Primary Examiner* — Steven A MacDonald
(74) *Attorney, Agent, or Firm* — Baker Hughes Patent Organization

(57) ABSTRACT

An inflow control device, including a housing, a flow restrictor defined within the housing, an outflow area defined within the housing fluidly connected to the flow restrictor; and a disperser disposed within the outflow area. A method for reducing erosion in an inflow control device, including flowing a fluid through a flow restrictor, creating a jet of fluid leaving the flow restrictor, impinging the jet on a disperser in an outflow area for the flow restrictor, and dispersing the jetting fluid. A borehole system including a borehole in a subsurface formation, an inflow control device disposed within the borehole.

18 Claims, 5 Drawing Sheets

INFLOW CONTROL DEVICE, METHOD, AND SYSTEM

BACKGROUND

In the resource recovery and fluid sequestration industries flow control devices are often needed for various reasons. The art continues to improve and find alternate technology for such devices but also continuously seeks improvement of those. Some inflow control devices suffer from significant erosion. The art will positively receive technologies that address excessive erosion.

SUMMARY

An embodiment of an inflow control device, including a housing, a flow restrictor defined within the housing, an outflow area defined within the housing fluidly connected to the flow restrictor; and a disperser disposed within the outflow area.

An embodiment of a method for reducing erosion in an inflow control device, including flowing a fluid through a flow restrictor, creating a jet of fluid leaving the flow restrictor, impinging the jet on a disperser in an outflow area for the flow restrictor, and dispersing the jetting fluid.

An embodiment of a borehole system including a borehole in a subsurface formation, an inflow control device disposed within the borehole.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
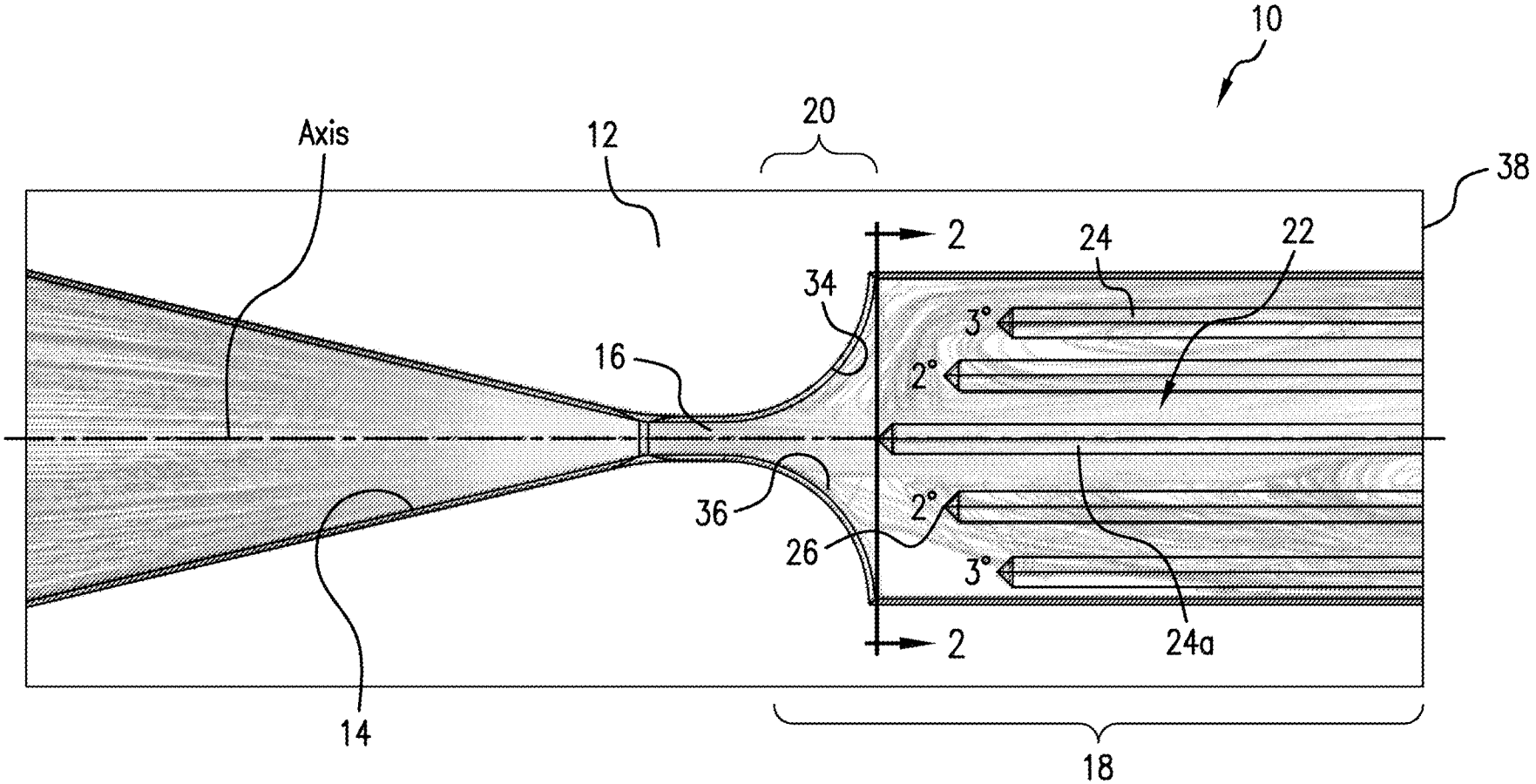
FIG. 1 is a schematic view of an inflow control device as disclosed herein.
Figure 2:
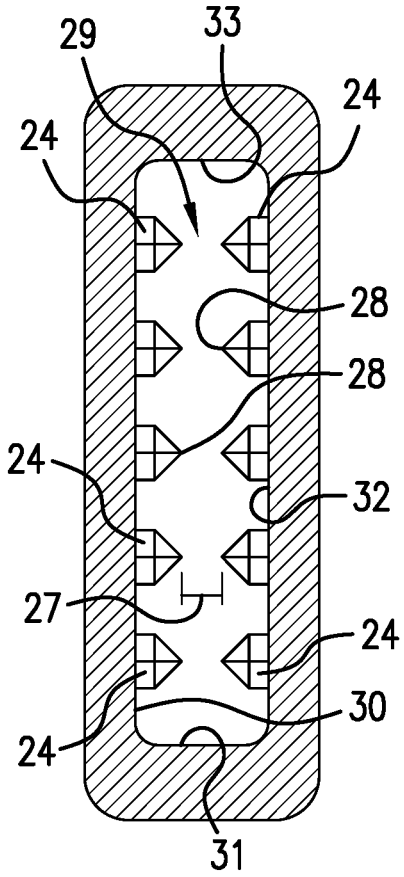
FIG. 2 is a cross section view of the illustration of FIG. 1 taken along 2-2.
Figure 3:
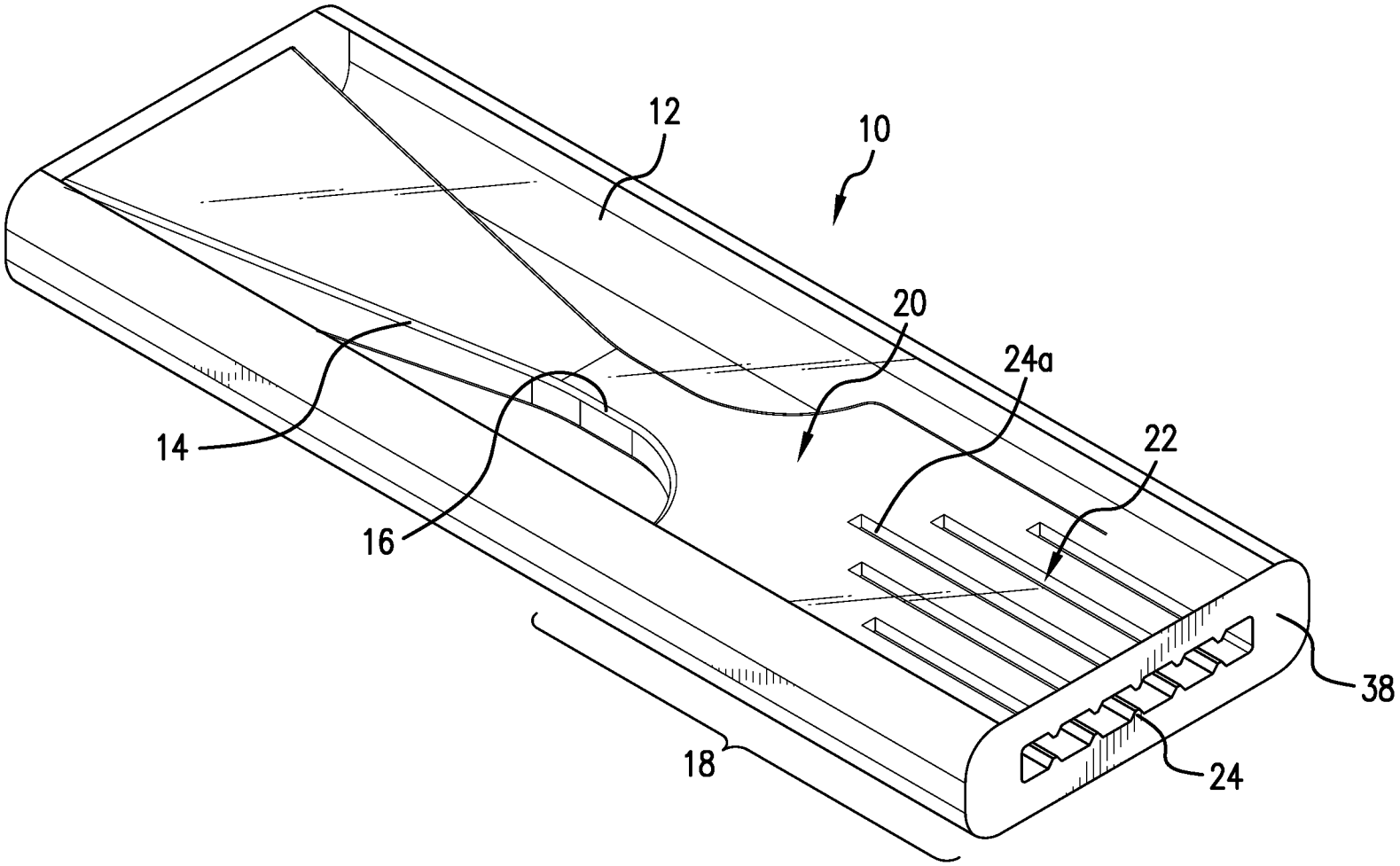
FIG. 3 is a perspective view of the device illustrate in FIG. 1.
Figure 4:
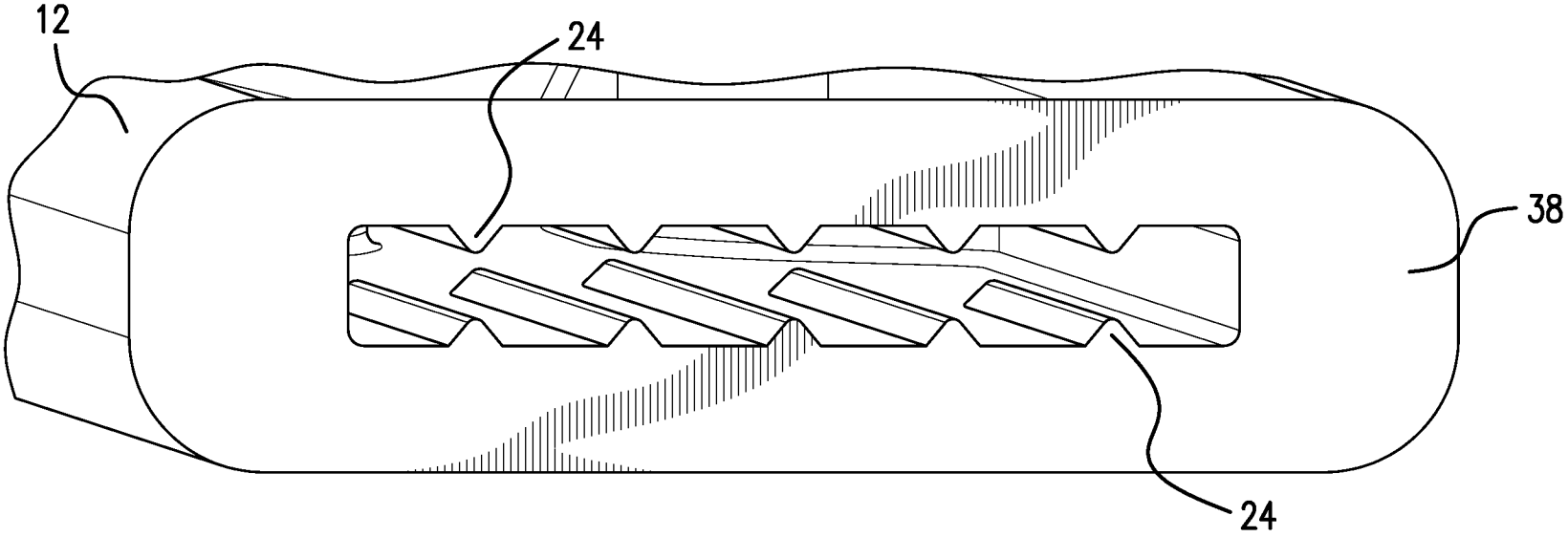
FIG. 4 is a perspective end view of FIG. 2.

A detailed description of one or more embodiments of the disclosed apparatus and method are presented herein by way of exemplification and not limitation with reference to the Figures.

Referring to FIGS. 1-4, an inflow control device 10 is illustrated. The device 10 includes a housing 12 that defines a flow restrictor 14, a flow restrictor throat 16, and an outflow area 18. The outflow area 18 includes an expansion area 20. Walls of the expansion area 20 are designated 34 and 36. Due to an average angle of walls 34 and 36 of the expansion area 20 relative to the axis of the flow restrictor 14, flowing fluid through the device 10, which is rapidly accelerated in the flow restrictor 14 and throat 16 while pressure of the fluid is reduced, tends to separate from the walls 34 and 36 and therefore form a jet. Jetting fluid increases erosion and is therefore undesirable in the context of the inflow control device 10. The disperser 22 is important to recharacterize the fluid to a more homogenous flow regime that is less likely to cause undue erosion.

Combatting the jetting fluid is a disperser 22 disposed within the outflow area 18 of device 10. The disperser 22 may comprise one or more features 24 such as ribs or similar structures. The disperser 22 may be axially aligned with the housing 12 or just aligned with the axis of the flow restrictor 14 in cases where the housing axis does not align with the flow restrictor axis. In one embodiment one of the features 24 of the disperser 22, that is designated 24*a* for clarity, may be specifically axially aligned with the flow restrictor 14 axis, which is identified by dashed line with the indicator "axis". Feature 24*a* may also be positioned immediately at the downstream end of the expansion area 20 in embodiments.

In embodiments, the features 24 may be configured with pointed surfaces 26 and 28 exposed to a volume 29 defined within the outflow area 18 between walls 30, 31, 32, and 33 thereof, though flat surfaces and rounded surfaces are also acceptable. In an embodiment, the features 24 may extend from walls 30 and 32 toward each other (see FIG. 2). A gap 27 between the features 24 extending from wall 30 and the features 24 extending from wall 32 helps increase dispersion of the fluid stream flowing through the outflow area 18.

The disperser 22 in the embodiment that includes the feature 24 that is axially aligned with the flow restrictor 14 functions to split the oncoming jetting fluid into smaller constituents. Those constituents are diverted outwardly (or toward the top and toward the bottom of FIG. 1, for reference). The split reduces the cohesion of the jet and changes the angle of movement of the fluid, thereby increasing turbulence in the fluid and degrading laminarity of the flow. In embodiments where second and or third features (or second and third sets of features 24) are present, these will split the already split oncoming flow again at each impingement location (noted on the drawing FIG. 1 as 2° and 3°. The laminar nature of the jetting fluid is reduced at each split due to increasing turbulence. The fluid flowing between the features 24 may transfer between "lanes" because of the gap 27 thereby further increasing turbulence. By the downstream end 38 of the inflow control device 10, the flowing fluid is substantially, if not completely, in a homogenous flow regime.

The method for reducing erosion in an inflow control device that employs a flow restrictor to accelerate fluid flowing therethrough and consequently generated a jetting fluid at the exit of the flow restrictor will have the jet mitigated by impinging the jet on the disperser 22 in the outflow area 18 of the device 10, and dispersing the jetting fluid with the disperser 22. In an embodiment the dispersing includes splitting the jetting flow. In a further embodiment, the dispersing includes intermingling the split flow and thereby increasing turbulence in the flow.

Figure 5:
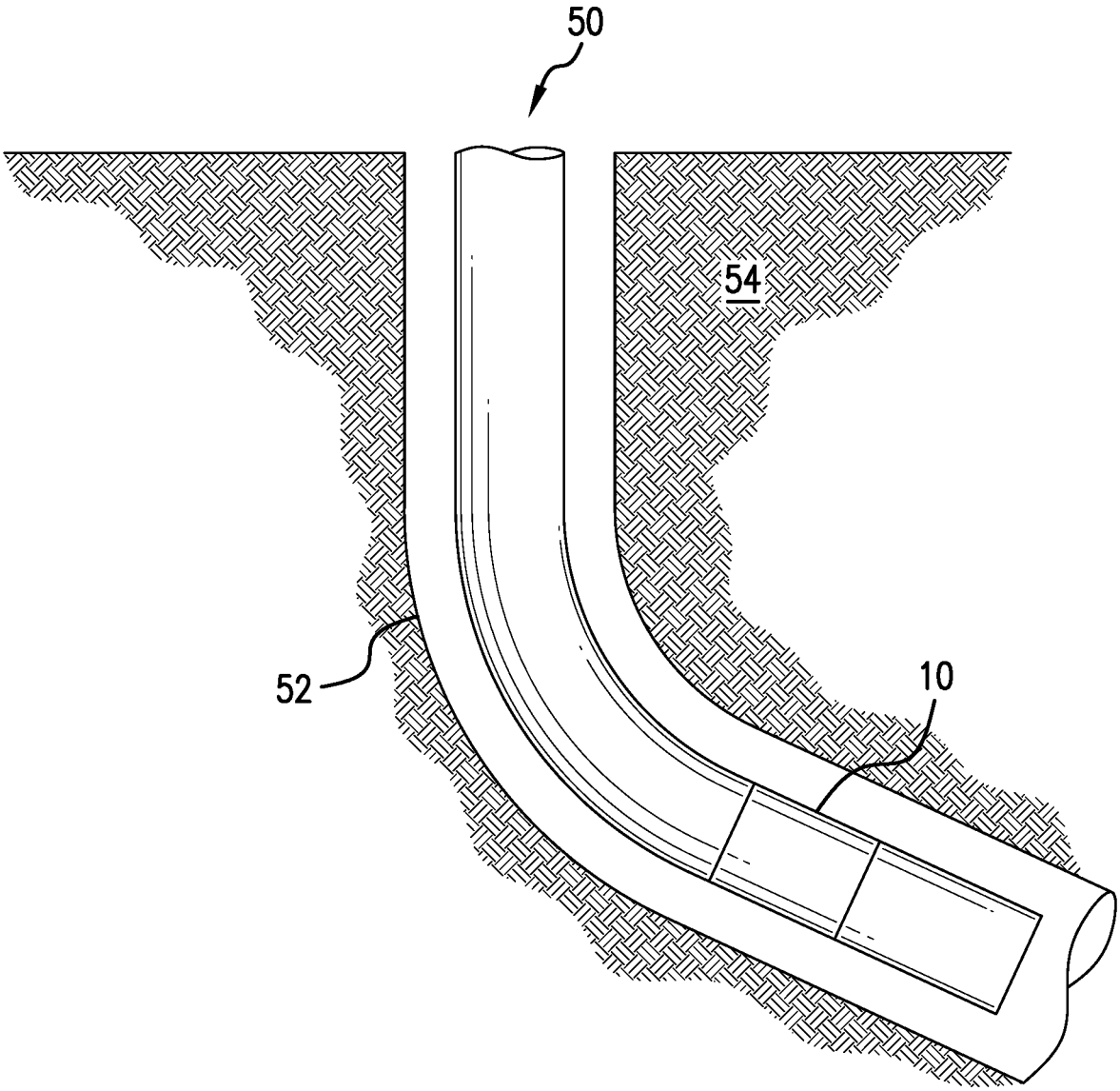
FIG. 5 is a view of a borehole system including the inflow control device as disclosed herein.

Referring to FIG. 5, a borehole system 50 is illustrated. The system 50 comprises a borehole 52 in a subsurface formation 54. An inflow control device 10 as disclosed herein is disposed within the borehole 52.

Set forth below are some embodiments of the foregoing disclosure:

Embodiment 1: An inflow control device, including a housing, a flow restrictor defined within the housing, an outflow area defined within the housing fluidly connected to the flow restrictor; and a disperser disposed within the outflow area.

Embodiment 2: The device as in any prior embodiment, wherein the disperser includes a first feature that is axially aligned with the flow restrictor.

Embodiment 3: The device as in any prior embodiment, wherein the disperser includes second features, the second features being positioned farther from the flow restrictor than the first feature.

Embodiment 4: The device as in any prior embodiment, wherein the second features are two and each is stepped back from the flow restrictor relative to the first feature by the same distance.

Embodiment 5: The device as in any prior embodiment, wherein the disperser includes third features, the third features being stepped back from the second features by the same distance.

Embodiment 6: The device as in any prior embodiment, wherein the outflow area includes an expansion area.

Embodiment 7: The device as in any prior embodiment, wherein the expansion area is continuously diverging from a throat of the flow restrictor.

Embodiment 8: The device as in any prior embodiment, wherein the disperser is located immediately downstream of the expansion area.

Embodiment 9: The device as in any prior embodiment, wherein the disperser includes pointed surfaces exposed to a volume of the outflow area.

Embodiment 10: The device as in any prior embodiment, wherein the disperser is a rib.

Embodiment 11: The device as in any prior embodiment, wherein the disperser is a plurality of ribs.

Embodiment 12: The device as in any prior embodiment, wherein the ribs extend from a wall of the outflow area into a volume of the outflow area.

Embodiment 13: The device as in any prior embodiment, wherein the ribs extend from two walls of the outflow area into a volume of the outflow area toward each other.

Embodiment 14: A method for reducing erosion in an inflow control device, including flowing a fluid through a flow restrictor, creating a jet of fluid leaving the flow restrictor, impinging the jet on a disperser in an outflow area for the flow restrictor, and dispersing the jetting fluid.

Embodiment 15: The method as in any prior embodiment, wherein the dispersing includes splitting the jetting flow.

Embodiment 16: The method as in any prior embodiment, wherein the dispersing includes intermingling the split flow.

Embodiment 17: The method as in any prior embodiment, wherein the dispersing includes introducing turbulence to the jetting flow.

Embodiment 18: A borehole system including a borehole in a subsurface formation, an inflow control device as in any prior embodiment disposed within the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow control device, comprising:

a housing;

a flow restrictor defined within the housing;

an outflow area defined within the housing fluidly connected to the flow restrictor; and a disperser disposed within the outflow area, the disperser defining a plurality of lanes, each having an upstream inlet and a downstream outlet, the outlet being generally in line with the inlet, the disperser configured to allow flow to move across the plurality of lanes in a direction in addition to from the inlet to the outlet.

2. The device as claimed in claim 1, wherein the disperser includes a first feature that is axially aligned with the flow restrictor.

3. The device as claimed in claim 2, wherein the disperser includes second features, the second features being positioned farther from the flow restrictor than the first feature.

4. The device as claimed in claim 3, wherein the second features are two and each is stepped back from the flow restrictor relative to the first feature by the same distance.

5. The device as claimed in claim 4, wherein the disperser includes third features, the third features being stepped back from the second features by the same distance.

6. The device as claimed in claim 1, wherein the outflow area includes an expansion area.

7. The device as claimed in claim 6, wherein the expansion area is continuously diverging from a throat of the flow restrictor.

8. The device as claimed in claim 6, wherein the disperser is located immediately downstream of the expansion area.

9. The device as claimed in claim 1, wherein the disperser includes pointed surfaces exposed to a volume of the outflow area.

10. The device as claimed in claim 1, wherein the disperser is a rib.

11. The device as claimed in claim 1, wherein the disperser is a plurality of ribs.

12. The device as claimed in claim 11, wherein the ribs extend from a wall of the outflow area into a volume of the outflow area.

13. The device as claimed in claim 11, wherein the ribs extend from two walls of the outflow area into a volume of the outflow area toward each other.

14. A method for reducing erosion in an inflow control device, comprising:

flowing a fluid through a flow restrictor;

creating a jet of fluid leaving the flow restrictor;

impinging the jet on a disperser in an outflow area for the flow restrictor, the disperser defining a plurality of lanes, each having an upstream inlet and a downstream outlet, the outlet being generally in line with the inlet, the disperser configured to allow flow to move across the plurality of lanes in a direction in addition to from the inlet to the outlet; and dispersing the jetting fluid.

15. The method as claimed in claim 14, wherein the dispersing includes splitting the jetting flow.

16. The method as claimed in claim 15, wherein the dispersing includes intermingling the split flow.

17. The method as claimed in claim 14, wherein the dispersing includes introducing turbulence to the jetting flow.

18. A borehole system comprising:

a borehole in a subsurface formation;

an inflow control device as claimed in claim 1 disposed within the borehole.

* * * * *